United States Patent [19]

Vierra et al.

[11] 3,979,786

[45] Sept. 14, 1976

[54] COMBINED SHOE TREE AND SHOE DEODORIZER

[75] Inventors: Frank Vierra; Joyce Vierra, both of Maxwell, Calif.

[73] Assignee: The Raymond Lee Organization, Inc., a part interest

[22] Filed: Apr. 4, 1975

[21] Appl. No.: 565,062

[52] U.S. Cl. ..... 12/128 B; 239/541; 239/565; 222/192; 222/402.1

[51] Int. Cl.[2] ..... A43D 3/14; B05B 1/32; B65D 83/14

[58] Field of Search ..... 12/128 R, 128 B; 239/541, 579

[56] References Cited

UNITED STATES PATENTS

| | | | |
|---|---|---|---|
| 464,550 | 12/1891 | Bowman | 239/541 |
| 3,431,749 | 3/1969 | Bounds et al. | 239/541 |

*Primary Examiner*—Patrick D. Lawson

[57] ABSTRACT

A vertical hollow tube closed at its top end has a first hole in its side wall adjacent its top end and is filled with gaseous deodorizer under pressure. A vertical hollow cylinder closed at its top end and open at its bottom end has a second hole in its side wall. The cylinder is vertically slidable up and down along the tube whereby the holes can be moved into and out of alignment. The deodorizer escapes from the tube to the outside through the holes when aligned and is otherwise confined within the tube. Spring means disposed within the cylinder between the top ends of cylinder and tube normally biases the cylinder in a position relative to the tube at which the second hole is out of alignment with and disposed above the first hole. When a shoe engages cylinder and tube with the cylinder disposed' inside the toe, the weight of the shoe overcomes the normal bias and the cylinder is moved downward until the second hole is out of alignment with and disposed below the first hole.

4 Claims, 6 Drawing Figures

GAS FILLED TREE BRANCH

COMBINED SHOE TREE AND SHOE DEODORIZER

SUMMARY OF THE INVENTION

This invention is directed toward a device which not only functions as a shoe tree upon which a shoe can be hung when not in use but also sprays the interior of the shoe automatically with a deodorizer when the shoe is first hung on the tree and when the shoe is removed from the tree whereby shoes are always maintained in essentially odor free condition when not in use.

In accordance with the principles of the invention, a vertical hollow tube is closed at its top end and has a first hole in its side wall adjacent its top end. The tube is filled with gaseous deodorizer under pressure.

A vertical hollow cylinder closed at its top end and open at its bottom end is vertically slidable up and down along the tube whereby the two holes can be moved into and out of alignment. The deodorizer escapes from the tube to the outside through the holes when aligned and is otherwise confined within the tube.

Spring means disposed within the cylinder between the top ends of cylinder and tube normally bias the cylinder in a position relative to the tube at which the cylinder hole is out of alignment with and disposed above the tube hole.

When a shoe is hung on the cylinder with the cylinder being disposed, for example, inside the toe, the weight of the shoe overcomes the normal bias and the cylinder moves downward until the cylinder hole is out of alignment with and disposed below the tube hole. As the cylinder moves downward, the two holes are moved momentarily into alignment and a first spray of deodorizer is directed into the shoe interior. When the shoe is removed for use, the removal of the weight enables the spring means to return the cylinder into the original raised position. As the cylinder moves upward, the two holes are again moved momentarily into alignment and a second spray of deodorizer is directed into the shoe interior while the shoe is being removed.

DETAILED DESCRIPTION OF PREFERRED EMBODIMENT

Figure 1:
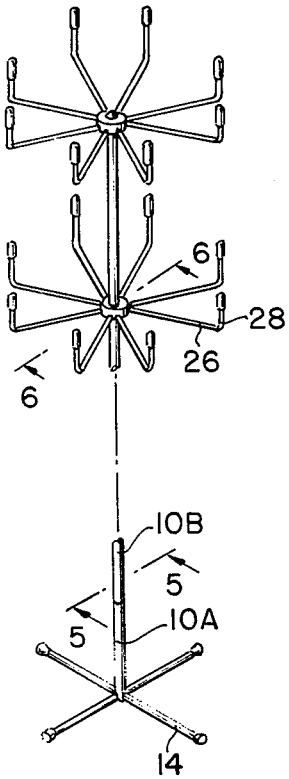
FIG. 1 is a perspective view of the invention.
Figure 6:
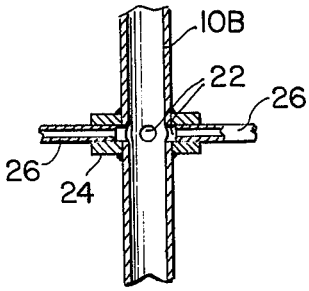
FIG. 6 is a view taken along line 6—6 in FIG. 1.

Referring now to FIGS. 1 – 6, a vertical hollow pipe length 10A is secured at its bottom end to the center of a horizontal X shaped member 14 which serves as base. The top end of length 10A is open. A spray can 12 containing an aerosol type gaseous deodorant is disposed removably in the length 10A. This can is of conventional type wherein depressing of its top disposed valve 16 causes the contents of the can to be discharged as a spray. A second hollow pipe length 10B is screwed on top of length 10A. A central recess 18 in the bottom closed end of length 10B receives and depresses valve 16 when the lengths are screwed together. The resultant spray is discharged into the interior of length 10B via a side opening 20 in the recess whereby the can is emptied of its contents.

Length 108 is closed at its top end and has spaced 10B 22 connected by spaced hollow rings 24 to open ends of horizontal lengths 26 of hollow tubing. The opposite end of each of these lengths is bent into a vertical length of tubing 28 which is closed at its top end. The portion of each length 28 adjacent its top end is of larger outer diameter as shown at 30 relative to the outer diameter of the remainder whereby shoulder 32 is formed. Each length 28 adjacent its top end has two holes 34 horizontally aligned and disposed opposite each other.

A separate hollow vertical cylinder 36 closed at its top end with a recess 38 in its top end is open at its bottom end and is vertically slidable along length 28, the top end of each length 28 being disposed within the interior of each cylinder 36. The inner surface of the wall of each cylinder 36 adjacent the bottom end has an inward lip 40 which can engage the adjacent shoulder 32 to prevent the cylinder from sliding off the length 28. The cylinder has two oppositely disposed horizontally aligned openings 42.

A coil spring 44 is disposed vertically in recess 38 with one end bearing against the cylinder and the other end bearing against the closed top end of the length 28.

Figure 2:
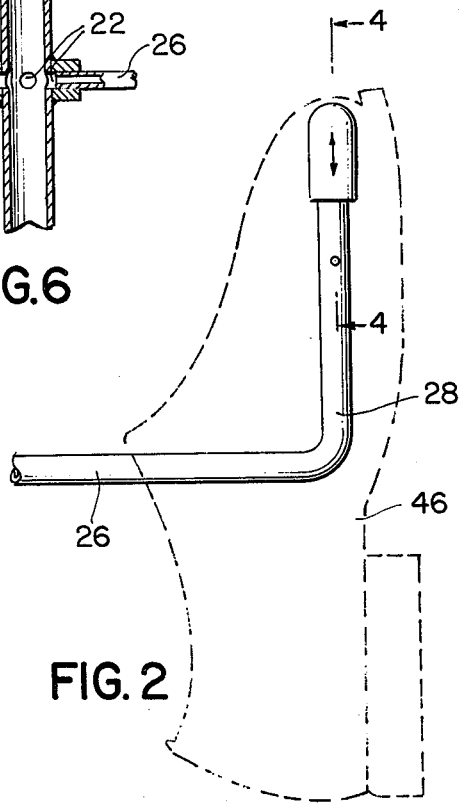
FIG. 2 is a detail side view of the invention with a shoe hung in storage position thereon.
Figure 5:
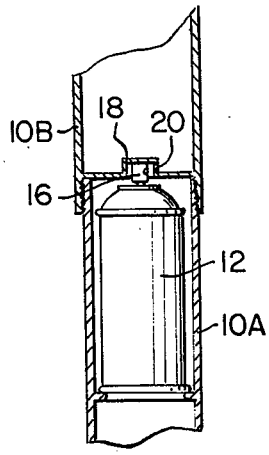
FIG. 5 is a view taken along lines 5—5 in FIG. 1.
Figure 3:
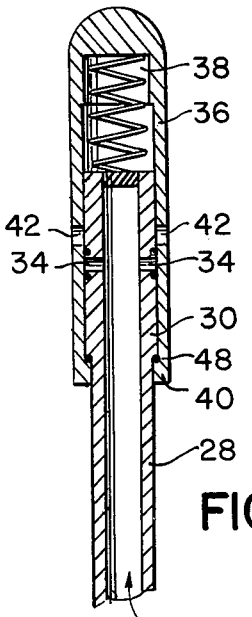
FIG. 3 is a detail view of a portion of the structure shown in FIG. 4 with the shoe removed.

In the absence of a shoe 46, (or other weight), the spring biases the holes 42 out of alignment with and above corresponding holes 34 as shown in FIG. 3. When a shoe is hung on a cylinder-tube combination as shown in FIG. 2, the holes 42 are moved out of alignment with and below holes 34 as shown in FIG. 4.

Figure 4:
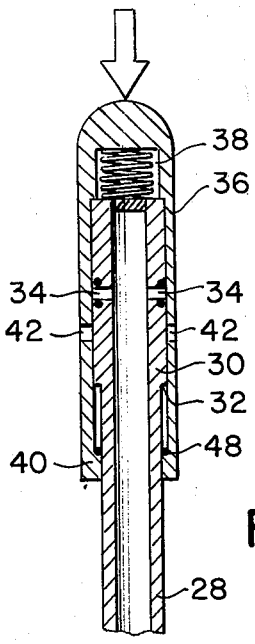
FIG. 4 is a view taken along line 4—4 in FIG. 2.

At one intermediate position of cylinder and tube, as momentarily established while the cylinder moves downward from the position of FIG. 3 to that of FIG. 4 or upward from the position of FIG. 4 to that of FIG. 3, the holes 42 are momentarily aligned with holes 34 and the deodorant spray is produced as described.

An O ring type seal 48 can be disposed between length and cylinder as shown to prevent leakage.

While the invention has been described with detailed reference to the drawings, the protection sought is to be limited only by the terms of the claims which follow.

We claim:

1. A combined shoe tree and shoe deodorizer comprising:

at least one vertical tube closed at its top end and having a first hole in the side wall adjacent the top end, said tube being filled with gaseous deodorizer under pressure;

a hollow vertical cylinder having a second hole in its side wall, the cylinder having a closed top end and an open lower end, the top end of the tube extending axially into the cylinder through the lower open end thereof, said cylinder being vertically slidable upwardly and downwardly with respect to the tube, whereby said holes can be moved into and out of alignment, said deodorizer escaping from the tube interior to the outside through the holes, when aligned and otherwise being confined within the tube; and spring means disposed within the cylinder between the top end of the cylinder and the top end of the tube, said means normally biasing the cylinder in a position relative to the tube at which the second hole is out of alignment with and disposed above the first hole, said cylinder, when a shoe engages the cylinder and tube in such manner that the cylinder is disposed within the toe of the shoe, being moved downward because the weight of the shoe overcomes the normal bias until the second hole is out of alignment with and disposed below the first hole.

2. The deodorizer of claim 1 further including sealing means disposed between cylinder and tube to prevent leakage of said deodorizer.

3. The deodorizer of claim 2 further including means disposed partially on the tube and partially on the cylinder to prevent said cylinder from sliding off the tube in the absence of said shoe.

4. The deodorizer of claim 3 including a horizontal tube open at both ends and secured at one end to the bottom end of the tube, said tube bottom end being open and means to supply said deodorizer under pressure to the opposite end of the horizontal tube.

* * * * *